US012729082B2

(12) United States Patent
Fuchi

(10) Patent No.: US 12,729,082 B2
(45) Date of Patent: Sep. 8, 2026

(54) SHEET STORAGE APPARATUS AND IMAGE FORMING SYSTEM INCLUDING THE SAME

(71) Applicant: KYOCERA Document Solutions Inc., Osaka (JP)

(72) Inventor: Masami Fuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 19/082,990

(22) Filed: Mar. 18, 2025

(65) Prior Publication Data

US 2025/0296794 A1 Sep. 25, 2025

(30) Foreign Application Priority Data

Mar. 22, 2024 (JP) ..... 2024-046569

(51) Int. Cl.
*B65H 1/14* (2006.01)
*B65H 1/04* (2006.01)
*B65H 7/14* (2006.01)

(52) U.S. Cl.
CPC ..... *B65H 1/14* (2013.01); *B65H 1/04* (2013.01); *B65H 7/14* (2013.01); *B65H 2403/544* (2013.01); *B65H 2553/412* (2013.01)

(58) Field of Classification Search
CPC ... B65H 1/04; B65H 1/08; B65H 1/14; B65H 7/02; B65H 7/14; B65H 2403/544; B65H 2405/15; B65H 2405/353; B65H 2553/412; B65H 2553/61
See application file for complete search history.

(56) References Cited

U.S. PATENT DOCUMENTS

2022/0258992 A1* 8/2022 Takano ..... B65H 1/14
2024/0025678 A1* 1/2024 Ando ..... B65H 1/14

FOREIGN PATENT DOCUMENTS

JP 2008013357 A * 1/2008
JP 2022-126021 A 8/2022

* cited by examiner

*Primary Examiner* — Prasad V Gokhale
(74) *Attorney, Agent, or Firm* — Stein IP, LLC

(57) ABSTRACT

With a wire wound up in a pulley portion, the wire is disposed in a pressing position extending along a tangential line common to the pulley portion and a pulley. The wire disposed in the pressing position presses a swing member against the urging force from an urging member such that the swing member approaches a sensor. With the wire completely unwound out of the pulley portion and hence with a sheet stacking tray disposed at the lowest position, the wire is disposed in a retracted position retracted from the pressing position. The wire disposed in the retracted position no longer presses the swing member and stays away from the sensor. A control portion stops a driving portion on recognizing the swing member having moved away from the sensor.

5 Claims, 6 Drawing Sheets

SHEET STORAGE APPARATUS AND IMAGE FORMING SYSTEM INCLUDING THE SAME

INCORPORATION BY REFERENCE

This application is based on and claims the benefit of priority from Japanese Patent Application No. 2024-046569 filed on Mar. 22, 2024, the contents of which are hereby incorporated by reference.

BACKGROUND

The present disclosure relates to a sheet storage apparatus and an image forming system including the same.

Conventional sheet storage apparatuses include a body housing, a sheet stacking tray, a pulley portion, a wire, and a driving portion. The sheet stacking tray is supported in the body housing so as to be capable of ascending and descending, and has sheets stacked on it. The pulley portion is supported in the body housing such that it can rotate about a rotation axis in a forward and a reverse direction. The wire has one end fixed to the pulley portion and has the other end fixed to the sheet stacking tray. The wire suspends the sheet stacking tray via a pulley. The wire is reeled in as the pulley portion rotates in the forward direction, and is reeled out as it rotates in the reverse direction. The driving portion makes the pulley portion rotate. The pulley portion is connected to the driving portion via a driving force transmission portion.

The driving force transmission portion transmits to the pulley portion only a rotational driving force in the forward direction from the driving portion, and it does not transmit to the pulley portion a rotational driving force in the reverse direction. This prevents, with the sheet stacking tray lowered at the lowest position (with the wire completely reeled out), further rotation of the pulley portion in the reverse direction under the rotational driving force. That is, it is possible to prevent the winding of the wire, instead of in the normal direction, in the opposite-to-normal direction with respect to the pulley portion, that is, what is called reverse winding. This prevents the sheet stacking tray from ascending as the pulley portion rotates in the reverse direction and from descending as the pulley portion rotates in the forward direction. Thus, it is possible to prevent a sheet feed failure to an image forming apparatus.

Inconveniently, the conventional sheet storage apparatuses have a driving force transmission portion with a complex structure, which may lead to a high manufacturing cost.

The present disclosure is made to cope with the above inconvenience and an object of the present disclosure is to provide a sheet storage apparatus that can, while suppressing an increase in the cost, prevent a sheet feed failure to an image forming apparatus and that is less prone to breakdown.

SUMMARY

To attain the above object, according to a first aspect of the present disclosure, a sheet storage apparatus includes a body hosing, a sheet stacking tray, a pulley portion, a wire, a driving portion, a sensing portion, and a control portion. The sheet stacking tray is supported in the body housing so as to be capable of ascending and descending with sheets stacked on it. The pulley portion is supported in the body housing so as to be rotatable about a rotation axis in forward and reverse directions. The wire has its one end fixed to the pulley portion and its other end fixed to the sheet stacking tray. The wire suspends the sheet stacking tray via a pulley. The wire is reeled in as the pulley portion rotates in the forward direction and is reeled out as the pulley portion rotates in the reverse direction. The driving portion makes the pulley portion rotate. The sensing portion senses the ascent/descent position of the sheet stacking tray. The control portion controls the driving portion. The sensing portion includes a swing member, a sensor, and an urging member. The swing member is supported so as to be swingable about a swing shaft as a fulcrum. The sensor senses the movement of the swing member toward and away from it. The urging member urges the swing member in a direction away from the sensor. With the wire wound up in the pulley portion, the wire is disposed in a pressing position extending along a tangential line common to the pulley portion and the pulley. The wire disposed in the pressing position presses the swing member against the urging force from the urging member such that the swing member approaches the sensor. With the wire completely unwound out of the pulley portion and hence with the sheet stacking tray disposed at the lowest position, the wire is disposed in a retracted position retracted from the pressing position. The wire disposed in the retracted position no longer presses the swing member and stays away from the sensor. The control portion stops the driving portion on recognizing the swing member having moved away from the sensor.

Another object of the present disclosure and a specific effect obtained through the present disclosure will be disclosed in more detail with an embodiment which will be described below.

DETAILED DESCRIPTION

Now, a description will be given of a sheet storage apparatus 20 and an image forming system 100 configured with the sheet storage apparatus 20, according to an embodiment of the present disclosure with reference to the accompanying drawings.

Figure 1:
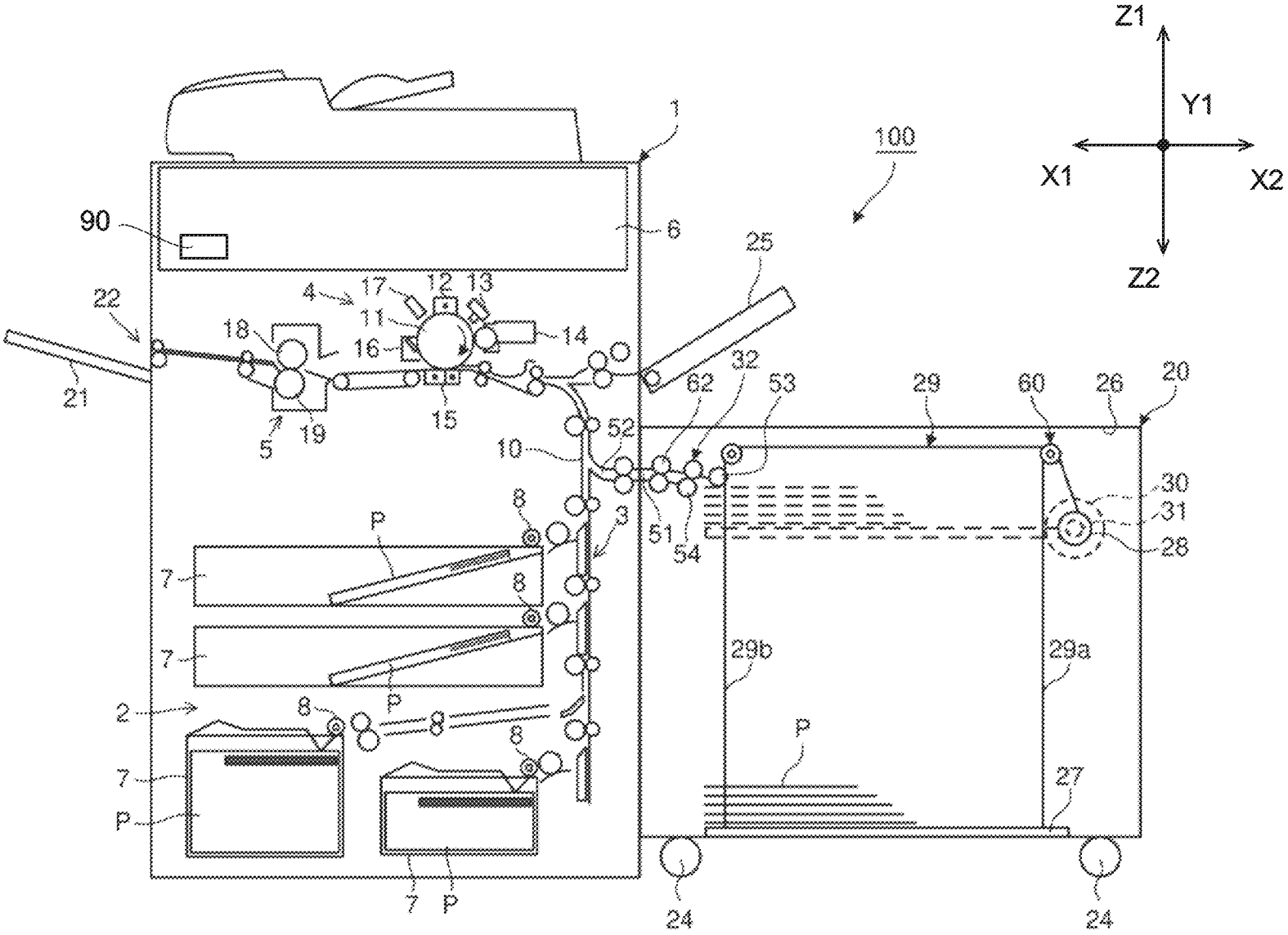
FIG. 1 is a schematic sectional view of a general structure of an image forming system 100 according to an embodiment of the present disclosure.

FIG. 1 is a schematic sectional view of a general structure of an image forming system 100. The image forming system 100 includes a sheet storage apparatus 20 and an image forming apparatus 1. The image forming apparatus 1 includes a sheet feeding portion 2 disposed in its lower part, a sheet conveying portion 3 disposed to a side X2 of the sheet feeding portion 2, an image forming portion 4 disposed above Z1 the sheet conveying portion 3, a fixing device 5 disposed at the discharge side of the image forming portion 4, and an image reading portion 6 disposed above Z1 the image forming portion 4 and the fixing device 5.

The sheet feeding portion 2 includes a plurality of sheet feed cassettes 7 each storing sheets P of plain paper. As a sheet feed roller 8 rotates, the sheet feeding portion 2 feeds out sheets P one by one reliably from a sheet feed cassette 7 selected from the plurality of sheet feed cassettes 7 to the sheet conveying portion 3.

A manual feed tray 25 has, placed on it, sheets P such as sheets of plain paper with a size different from the sheets P stored in the sheet feed cassettes 7, OHP sheets, or envelopes and feeds out those sheets P such as OHP sheets and envelopes to the sheet conveying portion 3.

A sheet P fed to the sheet conveying portion 3 is conveyed via a sheet feeding passage 10 to the image forming portion 4. The sheet feeding passage 10 extends upward from the sheet feed cassettes 7 and joins, at a position along its way, a junction passage 52 connected to a sheet discharging port 51 of the sheet storage apparatus 20, which will be described later.

The image forming portion 4 forms a toner image on a sheet P by an electrophotographic process. The image forming portion 4 includes a photosensitive member 11 pivoted so as to be rotatable in a direction indicated by an arrow in FIG. 1, and further includes, around the photosensitive member 11 along its rotational direction, a charging portion 12, an exposure portion 13, a developing device 14, a transferring portion 15, a cleaning portion 16, and a charge eliminating portion 17.

The charging portion 12 includes a charging wire to which a high voltage is applied. When corona discharge from the charging wire gives a predetermined electrical potential to the surface of the photosensitive member 11, the surface of the photosensitive member 11 is electrostatically charged evenly. Then, as light according to the image data of a document image read by the image reading portion 6 is shone from the exposure portion 13 to the photosensitive member 11, the surface potential on the photosensitive member 11 is selectively attenuated to form an electrostatic latent image on the surface of the photosensitive member 11.

The developing device 14 develops the electrostatic latent image on the surface of the photosensitive member 11 to form a toner image on the surface of the photosensitive member 11. The toner image is transferred, by the transferring portion 15, to the sheet P fed to between the photosensitive member 11 and the transferring portion 15.

The sheet P with the toner image transferred to it is conveyed toward the fixing device 5 disposed downstream of the image forming portion 4 in the sheet conveying direction. In the fixing device 5, a heating roller 18 (heating member) and a pressing roller 19 (pressing member) heats and presses the sheet P so as to fuse and fix the toner image to the sheet P. Then, the sheet P with the toner image fixed to it is discharged onto a discharging tray 21 by a pair of discharging rollers 22.

After the transfer by the transferring portion 15, the toner left on the surface of the photosensitive member 11 is removed by the cleaning portion 16 and the residual charge on the surface of the photosensitive member 11 is eliminated by the charge eliminating portion 17. Then, the photosensitive member 11 is again electrostatically charged by the charging portion 12 and image formation proceeds in the same manner as described above.

To a side X2 of the image forming apparatus 1, next to it, a sheet storage apparatus 20 is disposed with so high a capacity as to store the sheets P in units of thousands. The sheet storage apparatus 20 includes, housed in a body housing 26 as a housing of the sheet storage apparatus 20, a sheet stacking tray 27, a suspending member 60, a wire 29, a driving portion 30, and a sheet feeding device 32. The body housing 26 is formed substantially in the shape of a rectangular parallelepiped and has, attached on the bottom surface of the body housing 26, a plurality of casters 24 for easy transport of the sheet storage apparatus 20.

In an upper part of the body housing 26, the sheet feeding device 32 is disposed, which feeds sheets P downstream X1 in the sheet conveying direction. The sheet feeding device 32 includes a pick-up roller 53, a pair of sheet feed rollers 54, a pair of conveying rollers 62, and a sheet discharging port 51. The pick-up roller 53 is located above Z1 the sheet stacking tray 27, at such a position where, as the sheet stacking tray 27 ascends, the pick-up roller 53 makes contact with the top surface of the stacked sheets P. As the pick-up roller 53 rotates in a feeding direction (clockwise in FIG. 1) while contacting the top surface of the sheets P, one sheet P at the very top surface of the stack of sheets P is fed out.

The pair of sheet feed rollers 54 are disposed opposite each other downstream of the pick-up roller 53 with respect to the sheet conveying direction. The pair of conveying rollers 62 are disposed opposite each other downstream X1 of the pair of sheet feed rollers 54 with respect to the sheet conveying direction. The sheet discharging port 51 is located in a downstream end part of the sheet feeding device 32 with respect to the sheet conveying direction and is open in a side face of the body housing 26. The sheet P fed downstream by the pick-up roller 53 is conveyed further downstream by the pair of sheet feed rollers 54 and the pair of conveying rollers 62 to be discharged through the sheet discharging port 51 out of the sheet storage apparatus 20. To the sheet discharging port 51, the junction passage 52 of the image forming apparatus 1 is connected. Thus, the sheet P discharged through the sheet discharging port 51 is conveyed through the junction passage 52 into the sheet feeding passage 10 and is conveyed to the image forming portion 4 in the image forming apparatus 1, where image formation proceeds as described above.

Figure 2:
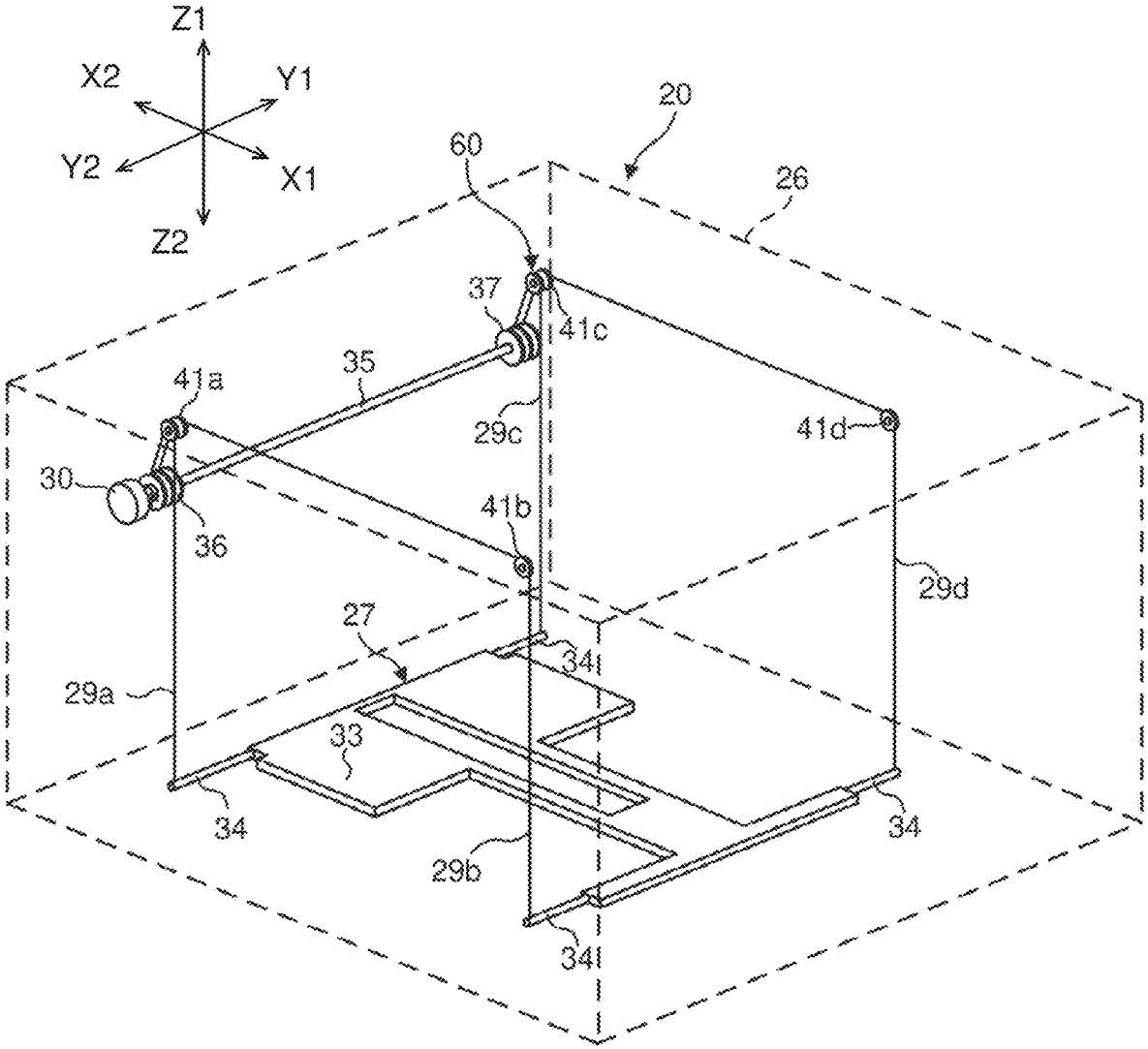
FIG. 2 is a perspective view showing the structure in a body housing 26 of a sheet storage apparatus 20.

FIG. 2 is a perspective view showing the structure in the body housing 26 of the sheet storage apparatus 20. The side face, at the far right Y1 in FIG. 2, of the body housing 26 is its side face at the front Y1 across the plane of FIG. 1. The width direction (Y1-Y2 direction) of the sheet P stored in the sheet storage apparatus 20 is the same as the front-rear direction of the body housing 26.

The sheet storage apparatus 20 includes a body housing 26, a sheet stacking tray 27, pulley portions 36 and 37, wires 29*a*, 29*b*, 29*c*, and 29*d*, a driving portion 30, a sensing portion 80, and a control portion 90.

The sheet stacking tray 27 is supported in the body housing 26 so as to be capable of ascending and descending along the top-bottom direction (Z1-Z2 direction). The sheet stacking tray 27 is configured with a tray portion 33, which is a member in the form of a plate extending parallel to the horizontal plane, and fixing portions 34 which each protrude outward from one of the four corners of the tray portion 33 along its width direction (Y1-Y2 direction). The sheets P are stacked on the tray portion 33.

The suspending member 60 is configured with four wires 29*a*, 29*b*, 29*c*, and 29*d*, two pulley portions 36 and 37, and four pulleys 41*a*, 41*b*, 41*c*, and 41*d*.

The pulley portions 36 and 37 are supported in the body housing 26 so as to be rotatable about a shaft member (rotation axis) 35 in the forward and reverse directions. The shaft member 35 extends along the horizontal direction (the width direction (Y1-Y2 direction) of the sheet P) orthogonal to the ascent/descent direction of the sheet stacking tray 27. The shaft member 35 is supported inside the body housing 26 so as to be rotatable in the forward and reverse directions (clockwise and counterclockwise in FIG. 1). The shaft member 35 has the pulley portions 36 and 37 fitted to it at its opposite ends with respect to the direction along the rotation axis of the shaft member 35 (which direction is hereinafter referred to as "axial direction").

The pulley portion 36 is fitted to one end part of the shaft member 35 (an end part of it at the rear Y2 of the image forming apparatus 1). The pulley portion 37 is fitted to another end part of the shaft member 35 (an end part of it at the front Y1 of the image forming apparatus 1). The pulley portions 36 and 37 and the shaft member 35 are disposed coaxially.

The wires 29*a* and 29*b* have one ends of them fixed to the pulley portion 36 and have the other ends of them fixed to a rear Y2 end part (i.e., fixing portion 34) of the sheet stacking tray 27 so as to suspend the sheet stacking tray 27 via the pulleys 41*a* and 41*b*. As the pulley portion 36 rotates in the forward direction C1, the wires 29*a* and 29*b* are reeled in and as the pulley portion 36 rotates in the reverse direction C2, they are reeled out. The wires 29*c* and 29*d* have one ends of them fixed to the pulley portion 37 and have the other ends of them fixed to a front Y1 end part (i.e., fixing portion 34) of the sheet stacking tray 27 so as to suspend the sheet stacking tray 27 via the pulleys 41*c* and 41*d*. As the pulley portion 37 rotates in the forward direction C1, the wires 29*c* and 29*d* are reeled in and as the pulley portion 37 rotates in the reverse direction, they are reeled out (see FIG. 5).

The pulleys 41*a* to 41*d* are rotatably supported in the body housing 26, above Z1 the pulley portions 36 and 37, downstream X1 of them in the sheet conveying direction. The wires 29*a* and 29*b* extend from the pulley portion 36 upward Z1 and are hung on the pulley 41*a*. The wire 29*a* extends from the pulley 41*a* vertically downward Z2 to suspend the sheet stacking tray 27. The wire 29*b* extends horizontally from the pulley 41*a* downstream X1 in the sheet conveying direction, and is hung on the pulley 41*b*, which is located farther X1, than the pulley 41*a*, from the pulley portion 28. The wire 29*b* extends from the pulley 41*b* vertically downward to suspend the sheet stacking tray 27.

The wires 29*c* and 29*d* extend from the pulley portion 37 upward Z1 and are hung on the pulley 41*c*. The wire 29*c* extends from the pulley 41*c* vertically downward Z2 to suspend the sheet stacking tray 27. The wire 29*d* extends horizontally from the pulley 41*c* downstream X1 in the sheet conveying direction, and is hung on the pulley 41*d*, which is located farther X1, than the pulley 41*a*, from the pulley portion 28. The wire 29*d* extends from the pulley 41*d* vertically downward to suspend the sheet stacking tray 27.

The driving portion 30 is disposed outward (opposite from the pulley portion 37) of the pulley portion 36 along the axial direction and is connected to the pulley portion 36. The driving portion 30 makes, via the shaft member 35, the pulley portions 36 and 37 rotate in the forward and reverse directions.

The control portion 90 is configured with a CPU and the like and is connected to a memory (not shown) composed of a ROM, a RAM, and the like. The control portion 90 controls different portions (such as the image forming portion 4 and the driving portion 30) in the image forming system 100 based on programs and data for control stored in the memory. That is, the control portion 90 controls the driving portion 30.

Figure 3:
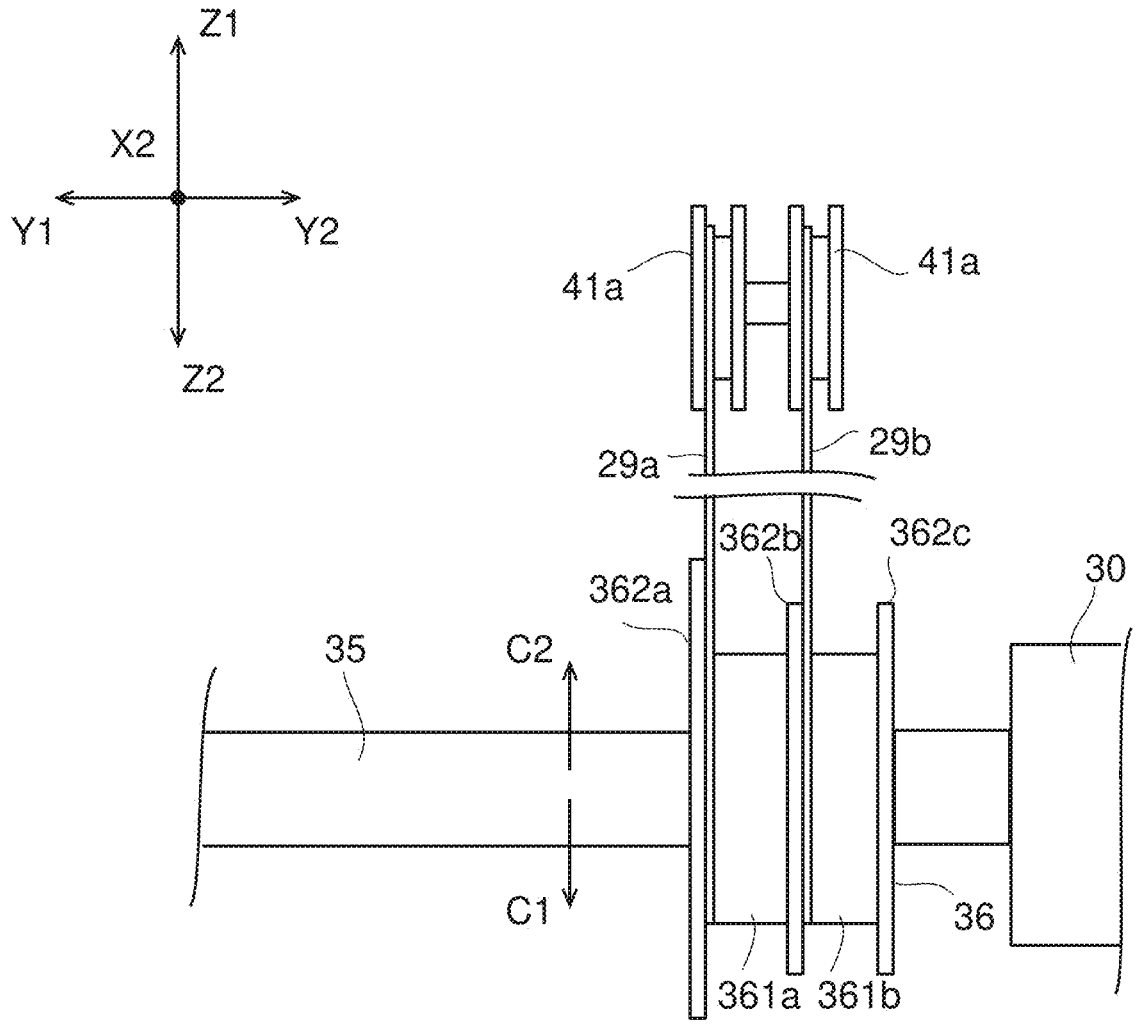
FIG. 3 is a side view around a pulley portion 36 as seen from the side X1 in FIG. 2.
Figure 4:
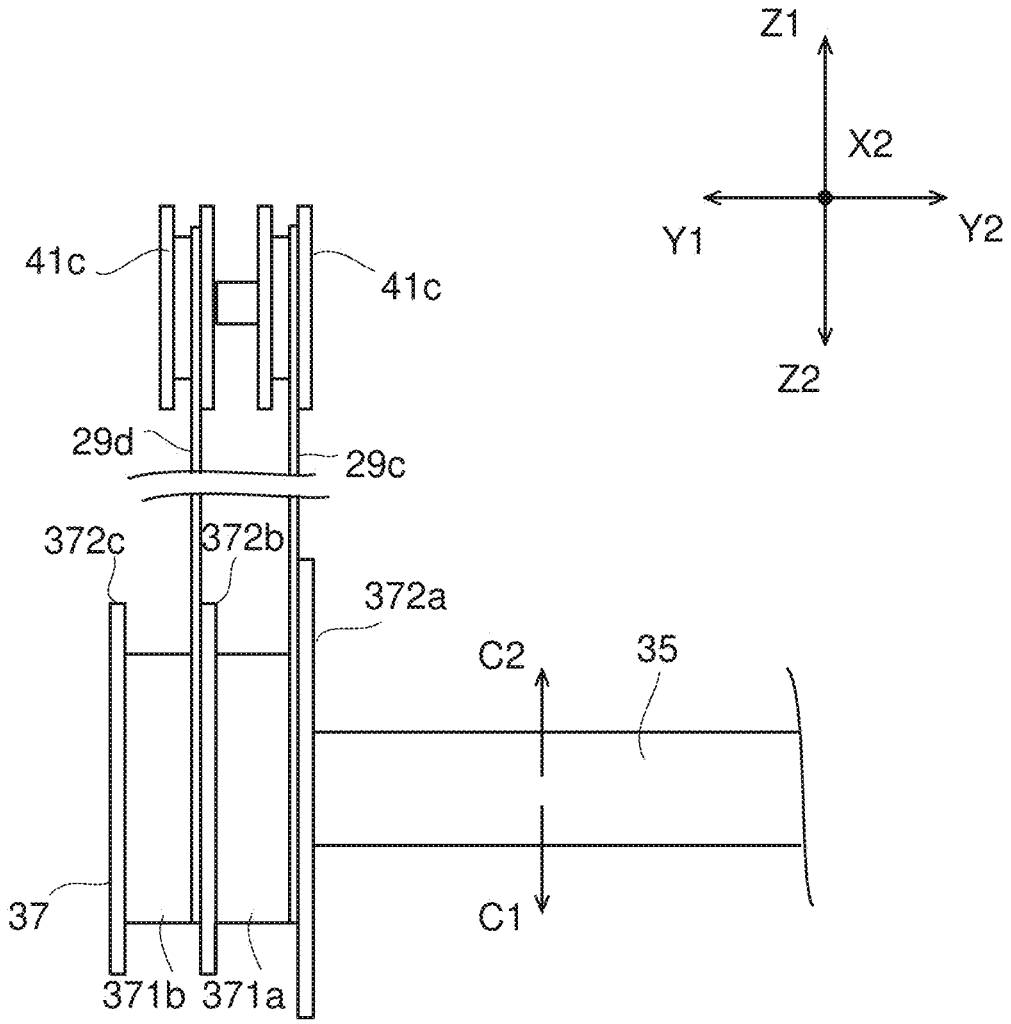
FIG. 4 is a side view around a pulley portion 37 as seen from the side X1 in FIG. 2.
Figure 5:
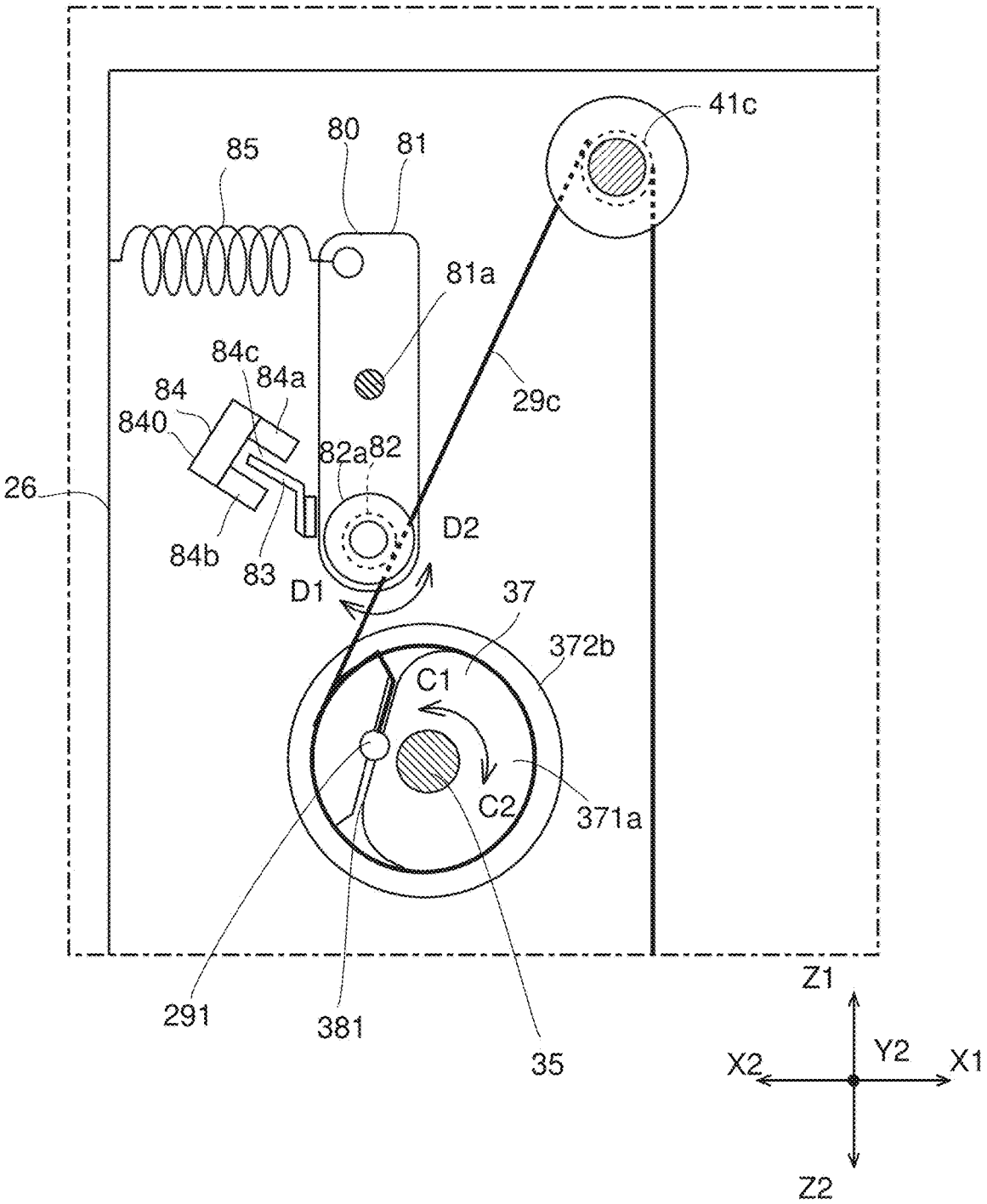
FIG. 5 is a side view around the pulley portion 37 as seen from the side Y2 in FIG. 2.
Figure 6:
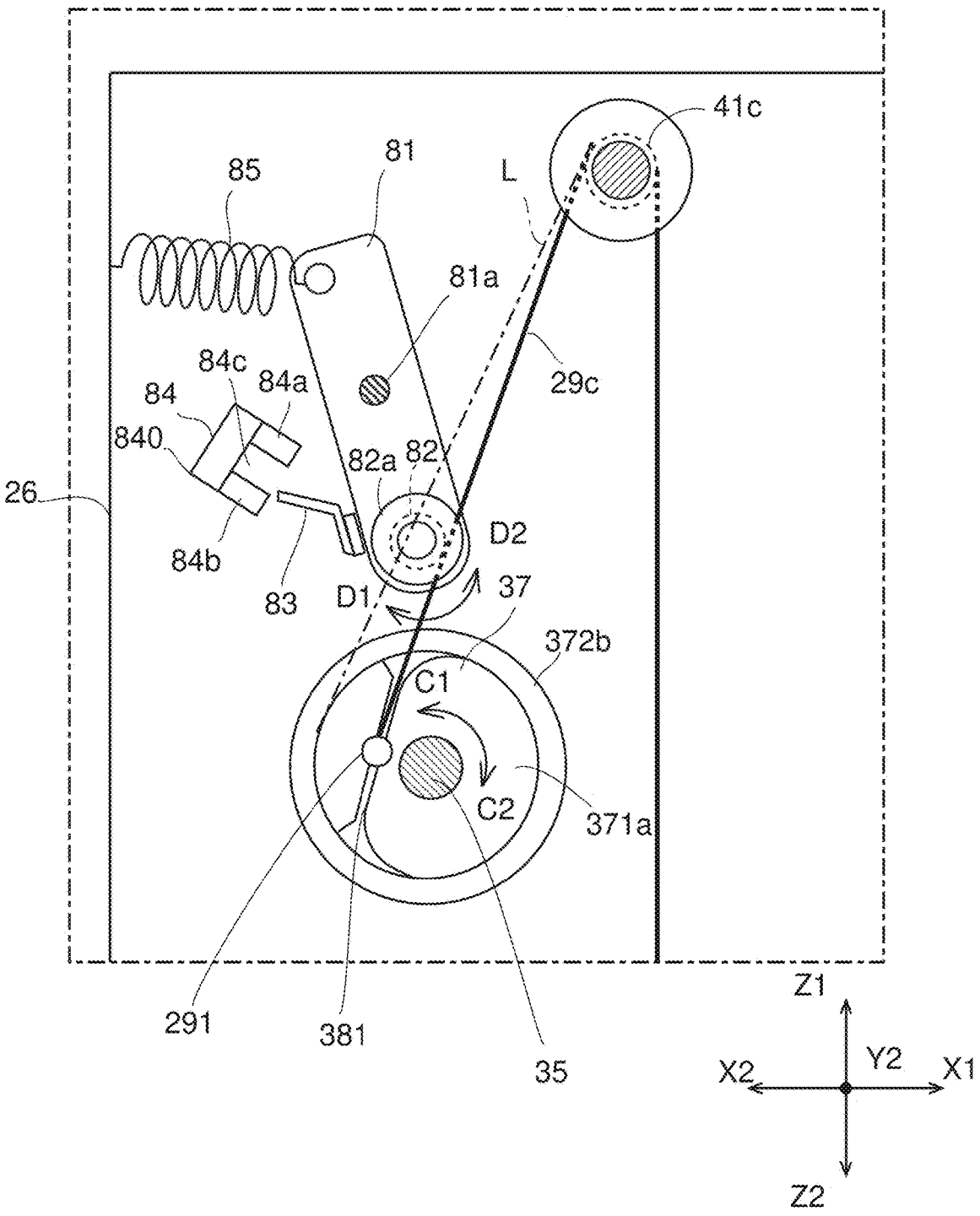
FIG. 6 is a side view around the pulley portion 37 as seen from the side Y2 in FIG. 2.

FIG. 3 is a side view around the pulley portion 36 as seen from the side X1 in FIG. 2 and FIG. 4 is a side view around the pulley portion 37 as seen from the side X1 in FIG. 2. In addition, FIGS. 5 and 6 are side views around the pulley portion 37 as seen from the side Y2 in FIG. 2, with flange portions 372*c* omitted from illustration. FIG. 5 shows the wire 29*c* wound up in the pulley portion 37 and FIG. 6 shows the wire 29*c* completely reeled out of the pulley portion 37. In FIG. 6, a tangential line L common to the pulley portion 37 and the pulley 41*c* is indicated by a chain line.

In the following description, with regard to the rotation direction of the pulley portion 28 and the direction of the rotational driving force from the driving device, the direction in which the wire 29 is reeled into the pulley portion 28 is defined as "forward direction" (arrow C1 direction) and the direction in which the wire 29 is reeled out of the pulley portion 28 is defined as "reverse direction" (arrow C2 direction).

The pulley portion 36 includes cylindrical reel portions 361*a* and 361*b*, which are adjacent to each other along the axial direction (Y1-Y2 direction) and flange portions 362*a* to 362*c*. The flange portions 362*a* to 362*c* are formed in an annular shape so as to protrude from the outer circumferential surfaces of the reel portions 361*a* and 361*b* in the radial direction, and are arrayed along the axial direction (Y1-Y2 direction).

The pulley portion 36 winds up the wire 29*a* with the wire 29*a* wound around the outer circumferential surface of the reel portion 361*a*. Likewise, the pulley portion 36 winds up the wire 29*b* with the wire 29*b* wound around the outer circumferential surface of the reel portion 361*b*.

Thus, as the pulley portion 36 rotates in the forward direction (C1 direction), the wires 29*a* and 29*b* are wound up. On the other hand, as the pulley portion 36 rotates in the reverse direction (C2 direction), the wires 29*a* and 29*b* are unwound.

The pulley portion 37 includes cylindrical reel portions 371*a* and 371*b*, which are adjacent to each other along the axial direction (Y1-Y2 direction), flange portions 372*b* and 372*c*, and a lid portion 372*a*. The flange portions 372*b* and 372*c* are formed in an annular shape so as to protrude from the outer circumferential surfaces of the reel portions 371*a* and 371*b* in the radial direction, and are arrayed along the axial direction (Y1-Y2 direction). The lid portion 372*a* is disposed on an inner Y2 end face of the reel portion 371*a* along the axial direction (i.e., one end face along the axial direction).

The pulley portion 37 winds up the wire 29*c* with the wire 29*c* wound around the outer circumferential surface of the reel portion 371*a*. Likewise the pulley portion 37 winds up the wire 29*d* with the wire 29*d* wound around the outer circumferential surface of the reel portion 371*b*.

Thus, as the pulley portion 37 rotates in the forward direction (C1 direction), the wires 29*c* and 29*d* are wound up. On the other hand, as the pulley portion 37 rotates in the reverse direction (C2 direction), the wires 29*c* and 29*d* are unwound.

The reel portion 371*a* has, on its inner Y2 end face along the axial direction (i.e., one end face along the axial direction), a straight groove portion 381 forming a secant of the pully portion 37. That is, the pulley portion 37 has, on its inner Y2 end face along the axial direction (i.e., one end face along the axial direction), the straight groove portion 381 forming a secant thereof. With the groove portion 381, an end part of the wire 29*c* can be engaged. Specifically, the wire 29*c* has, in an end part of it, a lock portion 291 in a spherical shape with a diameter larger than that of the wire 29*c* and the lock portion 291 is disposed in the groove portion 381. Thus, locking the lock portion 291 in the groove portion 381 permits easy fixing of the wire 29*c* to the pulley portion 37. In addition, the wire 29*c* is, at least in part of the groove portion 381, covered with the lid portion 372*a*.

The flange portions 362*a*, 362*b*, and 372*b* each have a cut portion (not shown). With the cut portions, end parts of the wires 29*a*, 29*b*, and 29*d* can be engaged. Specifically, like the wire 29*c*, the wires 29*a*, 29*b*, and 29*d* each have a lock portion (not shown) and the lock portions are locked in the cut portions. This permits the wires 29*a*, 29*b*, and 29*d* to be fixed to the pulley portions 36 and 37. Note that there is no particular limitation on how to fix the wires 29*a*, 29*b*, and 29*d* to the pulley portions 36 and 37.

The sensing portion 80 has a sensor 840, a swing member 81, a swing pulley 82, a swing rib 83, and an urging member 85. The sensor 840 senses the movement of the swing member 81 toward and away from it and, in the embodiment, the sensor 840 is configured with an optical sensor 84.

The swing member 81 is formed, for example, in the form of a rectangular plate and is supported so as to be swingable in a first direction D1 and a second direction D2 using, as the fulcrum, a swing shaft 81*a* extending along the axial direction. The first direction D1 is the direction toward the optical sensor 84 along the sheet conveying direction (X1-X2 direction). The second direction D2 is the direction away from the optical sensor 84 along the sheet conveying direction (X1-X2 direction). The swing shaft 81*a* is disposed at a middle part of the swing member 81 along the top-bottom direction (Z1-Z2 direction). The swing shaft 81*a* is located above Z1 the center axis of the pulley portion 37, upstream X2 of it in the sheet conveying direction. In addition, the swing shaft 81*a* is located below Z2 the center axis of the pulley 41*a*.

The swing pulley 82 is formed in a cylindrical shape extending along the axial direction (Y1-Y2 direction) and, in the embodiment, is disposed on a bottom end part of the swing member 81. The swing pulley 82 has a pulley flange portion 82*a* opposite from the swing member 81 along the axial direction (Y1-Y2 direction). Providing the pulley flange portion 82*a* prevents the wire 29*c* in contact with the swing pulley 82 from coming off the swing pulley 82. In the embodiment, the swing pulley 82 is supported on the swing member 81 so as to be rotatable about a rotation axis extending along the axial direction (Y1-Y2 direction). This suppresses the tear and hence breakage of the wire 20*c* resulting from its being rubbed with the outer circumferential surface of the swing pulley 82. Note that, while in the embodiment, the wire 29*c* is brought into contact via the swing pulley 82 with the swing member 81, in the present disclosure, there is no particular limitation on the shape of the swing pulley 82.

The swing rib 83 protrudes upstream X2 in the first direction sheet conveying direction from a bottom edge part of the swing member 81. That is, the swing rib 83 protrudes toward the optical sensor 84. The optical sensor 84 includes a light emitting portion 84*a* and a light receiving portion 84*b* disposed so as to face each other. Between the light emitting portion 84*a* and the light receiving portion 84*b*, an optical path 84*c* of the optical sensor 84 is formed. The swing rib 83 is disposed opposite the optical path 84*c* along the sheet conveying direction (X1-X2) and the swinging of the swing member 81 makes the swing rib 83 move into and out of the optical path 84*c* of the optical sensor 84. When the swing rib 83 moves into the optical path 84*c*, the sensing portion 80 recognizes an on state; when the swing rib 83 moves out of the optical path 84*c*, the sensing portion 80 recognizes an off state.

The urging member 85 is a coil spring and extends along the sheet conveying direction (X1-X2 direction). The urging member 85 has an upstream X2 end part of it in the sheet conveying direction fixed to the body housing 26 and has a downstream X1 end part of it in the sheet conveying direction fixed to a top end part of the swing member 81. The urging member 85 urges the top end part of the swing member 81 upstream X2 in the sheet conveying direction. In other words, the urging member 85 urges the swing member 81 in the direction away from the sensor 840.

While, in the embodiment, the urging member 85 has a downstream X1 end part of it in the sheet conveying direction fixed to a top end part of the swing member 81 to urge the top end part of the swing member 81 upstream X2 in the sheet conveying direction, this is not meant as any limitation. For example, the urging member 85 can have a downstream X1 end part of it in the sheet conveying direction fixed to a bottom end part of the swing member 81 to urge the bottom end part of the swing member 81 downstream X1 in the sheet conveying direction.

When the driving portion 30 exerts a rotational driving force in the forward direction (C1 direction), the shaft member 35 rotates in the forward direction (C1 direction) to make the pulley portions 36 and 37 rotate in the forward direction (C1 direction). This causes the wires 29*a* and 29*b* to be reeled into the reel portions 361*a* and 361*b* of the pulley portion 36, respectively. Likewise, the wires 29*c* and 29*d* are reeled into the reel portions 371*a* and 371*b* of the pulley portion 37, respectively. Thus, the sheet stacking tray 27 ascends.

With the wire 29*c* wound up in the pulley portion 37, the wire 29*c* is disposed in a pressing position (see FIG. 5) extending along the tangential line L common to the pulley portion 37 and the pulley 41*c*. The wire 29*c* disposed in the pressing position presses the swing pulley 82 of the swing member 81 against the urging force from the urging member 85. This makes the swing member 81 swing in the first direction D1. With the wire 29*c* disposed in the pressing position, the swing member 81 approaches the sensor 840 such that the swing rib 83 moves into the optical path 84*c* of the optical sensor 84. This brings the optical sensor 84 into the on state.

On the other hand, when the driving portion 30 exerts a rotational driving force in the reverse direction (C2 direction), the shaft member 35 rotates in the reverse direction (C2 direction) to make the pulley portions 36 and 37 rotate in the reverse direction (C2 direction). This causes the wires 29*a* and 29*b* to be reeled out of the reel portions 361*a* and 361*b* of the pulley portion 36, respectively. Likewise, the wires 29*c* and 29*d* are reeled out of the reel portions 371*a* and 371*b* of the pulley portion 37, respectively. Thus, the sheet stacking tray 27 descends.

When the wire 29*c* is completely reeled out of the pulley portion 37, the sheet stacking tray 27 is disposed at the lowest position. In this state, the wire 29*c* is disposed in a retracted position retracted from the pressing position (see FIG. 6). The wire 29*c* disposed in the retracted position no longer presses the swing member 81. With the wire 29*c* disposed in the retracted position, the swing member 81 moves away from the sensor 840 such that the swing rib 83 moves out of the optical path 84*c* of the optical sensor 84. This brings the optical sensor 84 into the off state.

Specifically, the wire 29*c* disposed in the retracted position is located downstream X1 of the common tangential line L in the sheet conveying direction. In this state, in a section orthogonal to the rotation axis of the pulley portion 37, the end part (lock portion 291) of the wire 29*c* is disposed between the common tangential line L and the rotation axis of the pulley portion 37 (see FIG. 6). Moreover, the wire 29*c* disposed in the retracted position extends straight from its end fixed to the pulley portion 37 up to the pulley 41*c*. Accordingly, adjusting the length of the wire 29*c* allows easy retraction and replacement of the wire 29*c* from the pressing position to the retracted position when the wire 29*c* is completely reeled out of the pulley portion 37.

The control portion 90 stops the driving portion 30 on recognizing the swing member 81 having moved away from the sensor 840. Specifically, the control portion 90 recognizes the swing member 81 having moved away from the sensor 840 when the swing rib 83 moves out of the optical path 84*c* of the optical sensor 84. In that case, the control portion 90 judges that the sheet stacking tray 27 is disposed at the lowest position and stops the driving portion 30. Thus, when the sheet stacking tray 27 descends down to the lowest position in the ascent/descent direction, the reeling-out of the wires 29*a* to 29*d* is stopped. This can reliably prevent reverse winding of the wires 29*a* to 29*d* resulting from the pulley portion 37 rotating in the reverse direction (C2 direction) after the wire 29*c* has been completely unwound out of the pulley portion 37. This also allows easy judgment, based on the position of the wire 29*c*, of whether the sheet stacking tray 27 is disposed at the lowest position. It is thus possible to provide a sheet storage apparatus 20 that can, while suppressing an increase in the cost, prevent a sheet feed failure to an image forming apparatus 1 and that is less prone to breakdown.

The above embodiment is not meant as any limitation on the present disclosure and thus various modifications can be made without departing from the sprit of the present disclosure. While, in the embodiment, the sensing portion 80 is disposed so as to correspond to the wire 29*c*, this is not meant as any limitation. For example, the sensing portion 80 can be located at a position corresponding to any of the wires 29*a*, 29*b*, and 29*c*.

While, in the embodiment, the optical sensor 84 is used as the sensor 840, this is not meant as any limitation on the present disclosure. As the sensor 840, instead of the optical sensor 84, a contact sensor can be used. One usable contact sensor is, for example, an interlock switch. When the swing member 81 makes contact with the interlock switch, the control portion 90 recognizes the swing member 81 being close to the sensor 840. On the other hand, when the swing member 81 is not in contact with the interlock switch, the control portion 90 recognizes the swing member 81 being away from the sensor 840.

The present disclosure finds application in sheet storage apparatuses with a high capacity that can store sheets to be fed to an image forming apparatus. With the present disclosure, it is possible to prevent a sheet feed failure from the sheet storage apparatus to the image forming apparatus.

What is claimed is:

1. A sheet storage apparatus comprising:

a body housing;

a sheet stacking tray supported in the body housing so as to be capable of ascending and descending, the sheet stacking tray being stacked with sheets;

a pulley portion supported in the body housing so as to be rotatable about a rotation axis in forward and reverse directions;

a wire having one end thereof fixed to the pulley portion and having another end thereof fixed to the sheet stacking tray, the wire suspending the sheet stacking tray via a pulley, the wire being reeled in as the pulley portion rotates in the forward direction and being reeled out as the pulley portion rotates in the reverse direction;

a driving portion making the pulley portion rotate;

a sensing portion sensing an ascent/descent position of the sheet stacking tray; and a control portion controlling the driving portion, wherein the sensing portion includes:

a swing member supported so as to be swingable about a swing shaft as a fulcrum;

a sensor sensing movement of the swing member toward and away from the sensor; and an urging member urging the swing member in a direction away from the sensor, with the wire wound up in the pulley portion, the wire is disposed in a pressing position extending along a tangential line common to the pulley portion and the pulley, the wire disposed in the pressing position presses the swing member against an urging force from the urging member such that the swing member approaches the sensor, with the wire completely unwound out of the pulley portion and hence with the sheet stacking tray disposed at a lowest position, the wire is disposed in a retracted position retracted from the pressing position, the wire disposed in the retracted position no longer presses the swing member and stays away from the sensor, and the control portion stops the driving portion on recognizing the swing member having moved away from the sensor.

2. The sheet storage apparatus according to claim 1, wherein the sensor is configured with an optical sensor including a light emitting portion and a light receiving portion disposed so as to face each other, the swing member protrudes toward the optical sensor and has a swing rib moving into and out of an optical path of the optical sensor, with the wire disposed in the pressing position, the swing rib lies in the optical path of the optical sensor, with the wire disposed in the retracted position, the swing rib lies out of the optical path of the optical sensor, and the control portion recognizes the swing member having moved away from the sensor when the swing rib moves out of the optical path of the optical sensor.

3. The sheet storage apparatus according to claim 1, wherein in a section orthogonal to the rotation axis, one end of the wire is disposed between the tangential line common to the pulley portion and the pulley and the rotation axis, and the wire disposed in the retracted position extends straight from the end thereof fixed to the pulley portion up to the pulley.

4. The sheet storage apparatus according to claim 1, wherein the pulley portion has, on one end face thereof along an axial direction, a groove portion forming a secant of the pulley, and the wire has, at one end thereof, a lock portion in a spherical shape with a diameter larger than a diameter of the wire, and with the lock portion disposed in the groove portion, the wire extends outward in the radial direction along the groove portion.

5. An image forming system comprising:

the sheet storage apparatus according to claim 1; and an image forming apparatus including an image forming portion forming an image on a sheet fed from the sheet storage apparatus.

* * * * *